US006267643B1

(12) United States Patent
Teng et al.

(10) Patent No.: US 6,267,643 B1
(45) Date of Patent: Jul. 31, 2001

(54) SLOTTED RETAINING RING FOR POLISHING HEAD AND METHOD OF USING

(75) Inventors: Kuo-Hsiu Teng, Zhong-he; Tseng-Hsuan Huang, Chuang-hua, both of (TW)

(73) Assignee: Taiwan Semiconductor Manufacturing Company, Ltd, hsin Chu (TW)

( * ) Notice: Subject to any disclaimer, the term of this patent is extended or adjusted under 35 U.S.C. 154(b) by 0 days.

(21) Appl. No.: 09/366,233

(22) Filed: Aug. 3, 1999

(51) Int. Cl.[7] ..... B24B 1/00; B24B 5/00

(52) U.S. Cl. ..... 451/41; 451/285; 451/287; 451/390; 451/397; 451/398

(58) Field of Search ..... 451/41, 285, 284, 451/287, 384, 385, 390, 397, 398, 402

(56) References Cited

U.S. PATENT DOCUMENTS 5,944,593 * 8/1999 Chiu et al. ..... 451/288
5,951,382 * 9/1999 Cravasse et al. ..... 451/285
5,967,885 * 10/1999 Crevasse et al. ..... 451/285
6,004,193 * 12/1999 Nagahara et al. ..... 451/285
6,062,963 * 5/2000 Lin et al. ..... 451/288
6,068,548 * 5/2000 Vote et al. ..... 451/287

* cited by examiner

*Primary Examiner*—M. Rachuba
(74) *Attorney, Agent, or Firm*—Tung & Associates

(57) ABSTRACT

The present invention discloses a slotted retaining ring for use in a chemical mechanical polishing head which can be fabricated by providing a plurality of slot recesses in a bottom surface of the retaining ring. Each of the plurality of slot recesses may be formed in a tapered shape with a base portion adjacent to the outer periphery of the ring and a tip portion of a smaller width than the base portion adjacent to the inner periphery of the retaining ring. The tip portion of the tapered shape is normally spaced apart from the inner periphery such that excessive polishing of the wafer edge can be avoided. The present invention further discloses a method for chemical mechanical polishing a semiconductor wafer by using the slotted retaining ring for holding a polishing head therein.

21 Claims, 3 Drawing Sheets

SLOTTED RETAINING RING FOR POLISHING HEAD AND METHOD OF USING

FIELD OF THE INVENTION

The present invention generally relates to a slotted retaining ring for use in a chemical mechanical polishing head and method of using the ring and more particularly, relates to a slotted retaining ring for a chemical mechanical polishing head that has a plurality of slot recesses provided on a bottom surface of the retaining ring in contact with a polishing pad such that an increased amount of slurry solution is pushed into grooves on the polishing pad surface for improved polishing efficiency and a method for using such slotted retaining ring.

BACKGROUND OF THE INVENTION

Apparatus for polishing thin, flat semi-conductor wafers is well-known in the art. Such apparatus normally includes a polishing head which carries a membrane for engaging and forcing a semi-conductor wafer against a wetted polishing surface, such as a polishing pad. Either the pad, or the polishing head is rotated and oscillates the wafer over the polishing surface. The polishing head is forced downwardly onto the polishing surface by a pressurized air system or, similar arrangement. The downward force pressing the polishing head against the polishing surface can be adjusted as desired. The polishing head is typically mounted on an elongated pivoting carrier arm, which can move the pressure head between several operative positions. In one operative position, the carrier arm positions a wafer mounted on the pressure head in contact with the polishing pad. In order to remove the wafer from contact with the polishing surface, the carrier arm is first pivoted upwardly to lift the pressure head and wafer from the polishing surface. The carrier arm is then pivoted laterally to move the pressure head and wafer carried by the pressure head to an auxiliary wafer processing station. The auxiliary processing station may include, for example, a station for cleaning the wafer and/or polishing head; a wafer unload station; or, a wafer load station.

More recently, chemical-mechanical polishing (CMP) apparatus has been employed in combination with a pneumatically actuated polishing head. CMP apparatus is used primarily for polishing the front face or device side of a semi-conductor wafer during the fabrication of semi-conductor devices on the wafer. A wafer is "planarized" or smoothed one or more times during a fabrication process in order for the top surface of the wafer to be as flat as possible. A wafer is polished by being placed on a carrier and pressed face down onto a polishing pad covered with a slurry of colloidal silica or alumina in de-ionized water.

A schematic of a typical CMP apparatus is shown in FIGS. 1A and 1B. The apparatus 10 for chemical mechanical polishing consists of a rotating wafer holder 14 that holds the wafer 10, the appropriate slurry 24, and a polishing pad 12 which is normally mounted to a rotating table 26 by adhesive means. The polishing pad 12 is applied to the wafer surface 22 at a specific pressure. The chemical mechanical polishing method can be used to provide a planar surface on dielectric layers, on deep and shallow trenches that are filled with polysilicon or oxide, and on various metal films. CMP polishing results from a combination of chemical and mechanical effects. A possible mechanism for the CMP process involves the formation of a chemically altered layer at the surface of the material being polished. The layer is mechanically removed from the underlying bulk material.

An altered layer is then regrown on the surface while the process is repeated again. For instance, in metal polishing a metal oxide may be formed and removed repeatedly.

A polishing pad is typically constructed in two layers overlying a platen with the resilient layer as the outer layer of the pad. The layers are typically made of polyurethane and may include a filler for controlling the dimensional stability of the layers. The polishing pad is usually several times the diameter of a wafer and the wafer is kept off-center on the pad to prevent polishing a non-planar surface onto the wafer. The wafer is also rotated to prevent polishing a taper into the wafer. Although the axis of rotation of the wafer and the axis of rotation of the pad are not collinear, the axes must be parallel. Polishing heads of the type described above used in the CMP process are shown in U.S. Pat. Nos. 4,141,180 to Gill, Jr., et al.; 5,205,082 to Shendon et al; and, 5,643,061 to Jackson, et al. It is known in the art that uniformity in wafer polishing is a function of pressure, velocity and the concentration of chemicals. Edge exclusion is caused, in part, by non-uniform pressure on a wafer. The problem is reduced somewhat through the use of a retaining ring which engages the polishing pad, as shown in the Shendon et al patent.

Referring now to FIG. 1C, wherein an improved CMP head, sometimes referred to as a Titan® head which differs from conventional CMP heads in two major respects is shown. First, the Titan® head employs a compliant wafer carrier and second, it utilizes a mechanical linkage (not shown) to constrain tilting of the head, thereby maintaining planarity relative to a polishing pad 12, which in turn allows the head to achieve more uniform flatness of the wafer during polishing. The wafer 10 has one entire face thereof engaged by a flexible membrane 16, which biases the opposite face of the wafer 10 into face-to-face engagement with the polishing pad 12. The polishing head and/or pad 12 are moved relative to each other, in a motion to effect polishing of the wafer 10. The polishing head includes an outer retaining ring 14 surrounding the membrane 16, which also engages the polishing pad 12 and functions to hold the head in a steady, desired position during the polishing process. As shown in FIG. 1C, both the retaining ring 14 and the membrane 16 are urged downwardly toward the polishing pad 12 by a linear force indicated by the numeral 18 which is effected through a pneumatic system.

In the polishing operation shown in FIG. 1B, the slurry solution 24 must be pushed into an interface between the wafer 10 and the polishing pad 12 in order for the chemical reaction and the mechanical removal process to operate efficiently. Since the surface of a silicon wafer is a hard surface and the surface of the polishing pad is normally formed of densely packed fibers, it is difficult to ensure an abundant supply of the slurry solution at the interface between the wafer and the polishing pad. Various techniques have been proposed to improve the supply of the slurry solution into the interface. Two of such techniques are shown in FIGS. 2A, 2B, 3A and 3B. FIGS. 2A and 2B show a technique in which a perforated polishing pad 28 is utilized. The perforated polishing pad 28 is formed with a multiplicity of perforations 30 through the pad thickness. As shown in FIG. 2B, typically, a perforation having a diameter of 0.075 in and a height of 0.05 in (i.e., through the complete thickness of the hard pad 32) is used. Alternatively, a more popularly used technique is to provide a grooved polishing pad 34 as shown in FIG. 3A. In the grooved polishing pad 34, grooves 36 are provided in a surface layer 38 of the hard pad. As shown in FIG. 3B, a typical groove is formed with a width of 0.01 in and a depth of 0.015 in, while the groove-to-groove distance is about 0.06 in. It should be noted that the perforations 30 and the grooves 36 are formed only through or in the hard pad layer and not into the soft pad layer.

While the perforated pad or the grooved pad shown in FIGS. 2A~3B provide some improvement over conventional polishing pads that have no surface modifications, the improvement is limited and the uniformity of the surface polishing is still less than ideal. It has been noticed that even though provisions have been provided on the polishing pad surface, the opposing surfaces of the wafer and the surrounding retaining ring are still hard and solid surfaces. The feeding of the slurry solution into the interface between the wafer and the polishing pad is therefore still difficult and limited.

It is therefore an object of the present invention to provide a slotted retaining ring for a CMP polishing head that does not have the drawbacks or shortcomings of the conventional retaining ring for such polishing head.

It is another object of the present invention to provide a slotted retaining ring for a CMP polishing head which has a plurality of slot recesses formed in a bottom surface of the retaining ring.

It is a further object of the present invention to provide a slotted retaining ring for a CMP polishing head that is constructed of a torroidal ring member that has parallelly situated planar top and bottom surfaces wherein the bottom surface is provided with a plurality of recesses.

It is another further object of the present invention to provide a slotted retaining ring adapted for holding a CMP head wherein a plurality of slot recesses are provided on a bottom surface of a retaining ring which are in a tapered shape.

It is still another object of the present invention to provide a slotted retaining ring adapted for holding a CMP head which has a plurality of recesses formed in the shape of trapezoidal shape with wide base portion adjacent to an outer periphery of the retaining ring.

It is yet another object of the present invention to provide a slotted retaining ring adapted for holding a CMP head that has a plurality of slot recesses in the bottom surface of the ring provided in trapezoidal shape with a tip portion adjacent to and spaced apart from an inner periphery of the retaining ring.

It is still another further object of the present invention to provide a method for chemical mechanical polishing a semiconductor wafer by using a polishing head equipped with a slotted retaining ring by first providing a plurality of trapezoidal shape slot recesses in a bottom surface of the retaining ring adapted for holding the polishing head.

It is yet another further object of the present invention to provide a method for chemical mechanical polishing a semiconductor wafer by using a polishing head which is equipped with a slotted retaining ring by first providing a plurality of slot recesses in a bottom surface of the ring and then rotating the retaining ring in a direction such that a wide base portion of the recess is advanced toward a slurry solution for transporting slurry solution toward the wafer to be polished.

SUMMARY OF THE INVENTION

In accordance with the present invention, a slotted retaining ring adapted for holding a CMP head and a method of using such slotted retaining ring are disclosed.

In a preferred embodiment, a slotted retaining ring that is adapted for holding a CMP head therein is provided which includes a torroidal ring member that has parallelly situated planar top and bottom surfaces, the torroidal ring member further includes an inner periphery defined by an inner diameter and an outer periphery defined by an outer diameter, the inner diameter is sufficiently large for holding a polishing head therein, and a plurality of slot recesses in the bottom surface of the torroidal ring, each of the plurality of slot recesses is formed in a tapered shape having a base portion adjacent to the outer periphery and a tip portion of a smaller width than the base portion adjacent to the inner periphery.

In the slotted retaining ring adapted for holding a CMP head, the torroidal ring member maybe formed in a concentric ring which has parallelly situated planar top and bottom surfaces. The torroidal ring member may have a rectangular cross-section. The plurality of slot recesses may include at least four slot recesses, or may include at least eight slot recesses. The tapered shape of the recesses may be in a triangular shape or in a trapezoidal shape. The trapezoidal shape may have a tip portion that is spaced apart from the inner periphery of the torroidal ring member. The two sloped sides of the trapezoidal shape each may have an angle between about 40° and about 70° as measured from a tangent line to the outer periphery of the ring member. A width of a bottom side of the trapezoidal shape slot recess is between about 5 mm and about 20 mm, and a width of a top side of the trapezoidal shape slot recess may be between about 1 mm and about 8 mm.

In an alternate embodiment, a chemical mechanical polishing head for carrying out a CMP process can be provided which includes a slotted retaining ring constructed by a toroidal ring member that has parallelly situated planar top and bottom surfaces, the toroidal ring member may further have an inner periphery defined by an inner diameter and an outer periphery defined by an outer diameter, the inner diameter may be sufficiently large for holding a polishing head therein, and a plurality of slot recesses in the bottom surface of the toroidal ring, each of the plurality of slot recesses may be formed in a tapered shape which has a base portion adjacent to the outer periphery and a tip portion of smaller width than the base portion adjacent to the inner periphery, and a polishing head adapted for mounting inside the slotted retaining ring and for carrying a wafer which has a surface to be polished therein, the bottom surface has a plurality of slot recesses of the slotted retaining ring is substantially in the same plane as the surface of the wafer to be polished.

In the CMP head, the toroidal ring member may have a rectangular cross-section. The plurality of slot recesses may include between about 4 and about 16 slot recesses. The tapered shape of the slot recesses may be a triangular or a trapezoidal shape. The trapezoidal shape may have a tip portion that is spaced apart from the inner periphery of the toroidal ring member. The two sloped sides of the trapezoidal shape each has an angle between about 40° and about 70° as measured from a tangent line to the outer periphery of the ring member. A width of a bottom side of the trapezoidal shaped slot recess is between about 5 mm and about 20 mm, while a width of a top side of the trapezoidal shape slot recess may be about 1 mm and about 8 mm.

The present invention is further directed to a method for chemical mechanical polishing a semiconductor wafer by using a polishing head which is equipped with a slotted retaining ring including the steps of first providing a slotted retaining ring adapted for holding a CMP head including a toroidal ring member that has parallelly situated planar top and bottom surfaces, the toroidal ring member may further include an inner periphery defined by an inner diameter and an outer periphery defined by an outer diameter, the inner diameter may be sufficiently large for holding a polishing head therein, and a plurality of slot recesses in the bottom surface of the toroidal ring, each of the plurality of slot recesses is formed in a tapered shape which has a base portion adjacent to the outer periphery and a tip portion of a smaller width than the base portion adjacent to the inner periphery, mounting a polishing head inside the slotted retaining ring such that a front surface of a wafer mounted in the polishing head to be polished may be substantially in the same plane as the bottom surface of the slotted retaining ring, and rotating the slotted retaining ring in a direction such that the base portion adjacent to the outer periphery of the toroidal ring member is advanced toward a slurry solution dispensed on a polishing pad.

In the method for chemical mechanical polishing a semiconductor wafer, the slotted retaining ring may be rotated in a clockwise direction. The slotted retaining ring may be rotated in a clockwise direction such that a flow of slurry solution is fed from the outer periphery to the inner periphery of the slotted retaining ring. The method may further include the step of providing at least four slot recesses in the bottom surface of the toroidal ring. The method may further include the step of providing at least slot recesses in the bottom surface of the toroidal ring for feeding a flow of slurry solution from the outer periphery to the inner periphery of the slotted retaining ring. The method may further include the step of forming the tapered shape slot recesses in a trapezoidal shape which has a tip portion that is spaced apart from the inner periphery of the toroidal ring member. The method may further include the step of chemical mechanical polishing the semiconductor wafer after an oxide deposition step, a tungsten deposition step or a polysilicon deposition step.

BRIEF DESCRIPTION OF THE DRAWINGS

These and other objects, features and advantages of the present invention will become apparent from the following detailed description and the appended drawings in which.

DETAILED DESCRIPTION OF THE PREFERRED EMBODIMENT

Figure 1A:
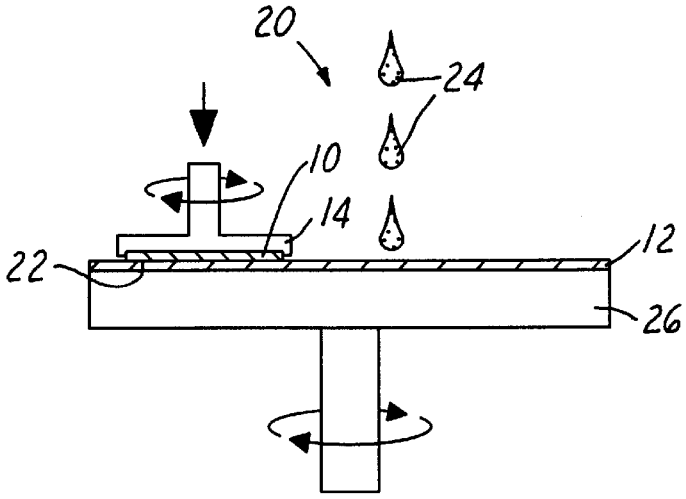
(Prior Art) FIG. 1A
FIG. 1A is a cross-sectional view of a conventional chemical mechanical polishing apparatus.
Figure 1B:
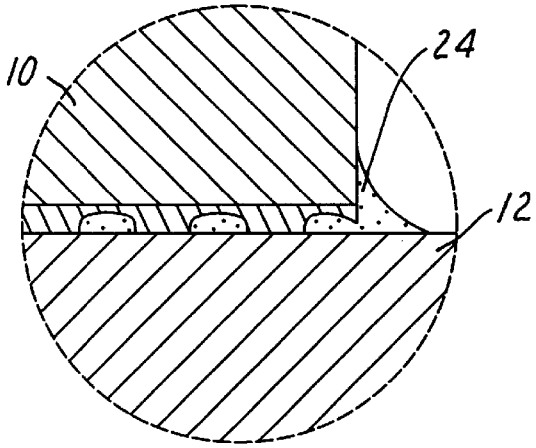
(Prior Art) FIG. 1B
FIG. 1B is a partial, enlarged cross-sectional view taken from FIG. 1A illustrating an interaction of slurry solution between the wafer and the polishing pad.
Figure 1C:
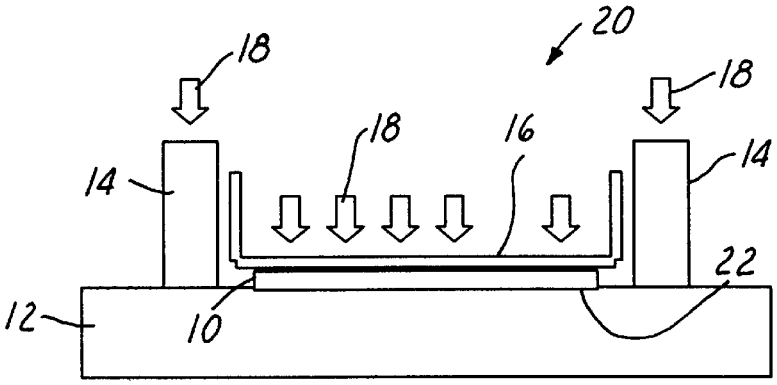
(Prior Art) FIG. 1C
FIG. 1C is a cross-sectional view of an improved polishing head utilizing a member pressurizing device.
Figure 2A:
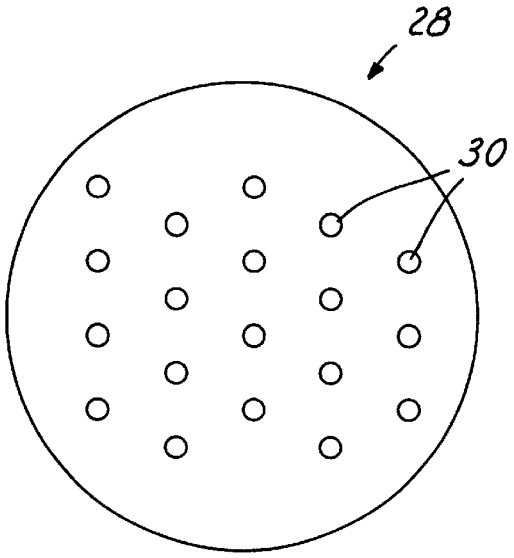
(Prior Art) FIG. 2A
FIG. 2A is a plane view of a conventional polishing pad with perforations.
Figure 3A:
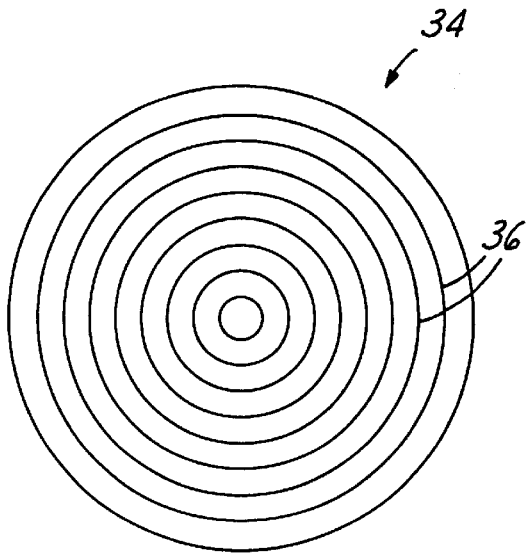
(Prior Art) FIG. 3A
FIG. 3A is a plane view of a conventional polishing pad equipped with grooves in the pad surface.
Figure 2B:
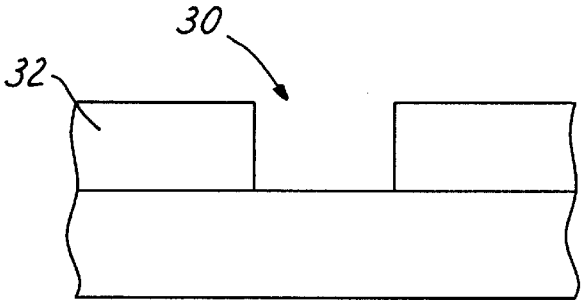
(Prior Art) FIG. 2B
FIG. 2B is a partial, enlarged cross-sectional view of a perforation shown in FIG. 2A.
Figure 3B:
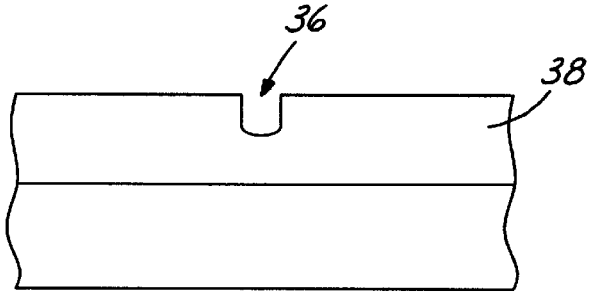
(Prior Art) FIG. 3B
FIG. 3B is a partial, enlarged cross-sectional view of a groove in the grooved polishing pad of FIG. 3A.

The present invention discloses a slotted retaining ring for use in a chemical mechanical polishing head which includes a toroidal shaped ring member that has a bottom surface equipped with a plurality of slot recesses. Each of the plurality of slot recesses is formed in a tapered shape that has a base portion adjacent to an outer periphery and a tip portion of a smaller width than the base portion adjacent to an inner periphery of the toroidal ring member. The tapered shape of the slot recesses may be formed in either a triangular shape or a trapezoidal shape. The tip portion of the tapered shape is spaced apart from the inner periphery of the toroidal ring member such that it does not provide an opening in the inner periphery of the ring member. This is an important point since excessive slurry solution would be delivered to the edge of a wafer being polished when the tip portion of the tapered slot recess is opened through the inner periphery of the ring member.

The present invention novel slotted retaining ring is able to scoop up the slurry solution disposed on the surface of the polishing pad by the large base portion of the slot recess and, with the rotation of the retaining ring in the proper direction, delivers and redistributes the extra slurry solution throughout the area of the taper for filling the grooves in the polishing pad that is covered by the tapered shape. The present invention novel slotted retaining ring therefore is capable of pushing more slurry solution into the grooves present on the polishing pad such that the polishing efficiency by the slurry solution can be greatly improved. For instance, it has been found that the flow rate of the slurry solution can be reduced from a normal 200 ml/min to about 100 ml/min while maintaining the same polishing efficiency. Furthermore, with the present invention novel slotted retaining ring, not only the usage of the slurry solution can be reduced, the wafer to wafer uniformity in polish thickness may further be improved.

Since one of the major expenses in a chemical mechanical polishing process is the cost of the slurry solution used, the present invention novel retaining ring can reduce significantly the cost of a chemical mechanical polishing process. In a conventional CMP process, only a fraction of the slurry solution dispensed on a polishing pad is actually used on the wafer surface. The present invention retaining ring therefore greatly improves the utilization efficiency of the slurry solution in contacting the wafer surface polished.

The present invention novel retaining ring therefore is capable of not only to reduce the fluctuation of wafer-to-wafer removal rates, to reduce the slurry solution usage, but also capable of producing improved uniformity of polishing thickness across a wafer surface and thus reducing rework frequency required. The present invention novel retaining ring supplements the function of a conventional retaining ring in which when a polishing head sweeps on a polishing pad, slurry is delivered to the wafer surface only through the grooves provided on the polishing pad.

In the present invention novel retaining ring, tapered slot recesses may be designed in a trapezoidal shape with the tip portion of the trapezoid not contacting the inner periphery of the ring. The purpose of the design is to avoid a fast polishing effect on the edge of the wafer polished.

Figure 4A:
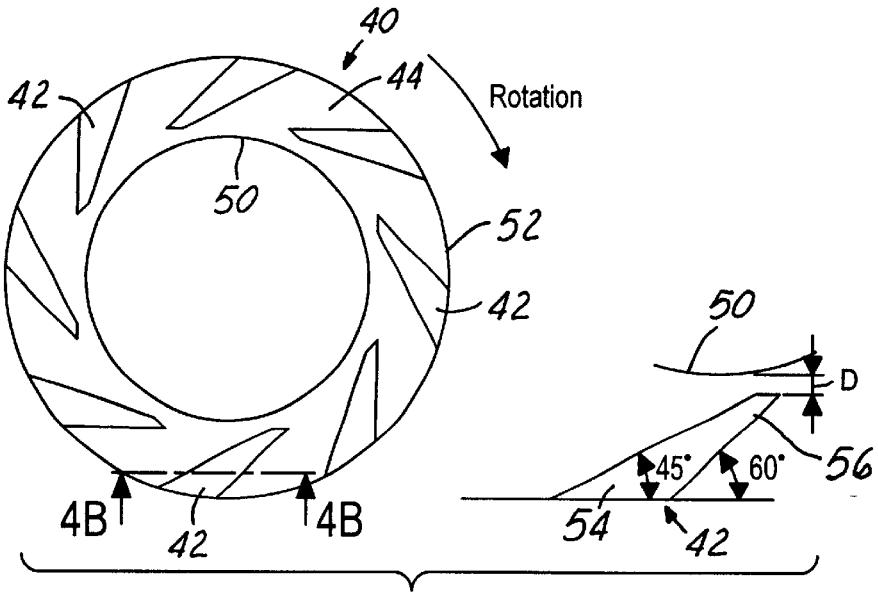
FIG. 4A is a plane view of a bottom side of the present invention slotted retaining ring.
Figure 4B:
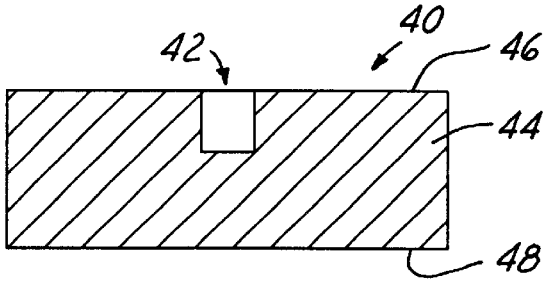
FIG. 4B is a cross-sectional view taken along section AA of FIG. 4A illustrating the slot recess.

Referring now to FIG. 4A, wherein a plane view of the bottom surface of a present invention slotted retaining ring 40 is shown. The slotted retaining ring 40 which is adapted for holding a wafer to be polished (not shown) is constructed in a toroidal-shaped ring member 44 which has parallely situated planar top and bottom surfaces 46, 48. This is shown in FIG. 4B in a cross-sectional view taken along line AA of FIG. 4A. The toroidal shaped ring member 44 has an inner periphery 50 defined by an inner diameter and an outer periphery 52 defined by an outer diameter. The inner diameter is sufficiently large such that a polishing head (not shown) can fit therein. In the bottom surface 46 (which is shown in FIG. 4B facing up), a plurality of slot recesses 42 are formed. Each of the plurality of slot recesses may be formed in a tapered shape which has a base portion 54 adjacent to the outer periphery 52 and a tip portion 56 of smaller width than the base portion adjacent to the inner periphery 50. It should be noted that the slot recess 42 shown in FIG. 4A is in a trapezoidal shape, even though a triangular shape may also be used. The tip portion 56 of the slot recess 42 is spaced apart from the inner periphery 50 by a distance "D" such that the slot recess is not opened through the inner periphery 50.

The slotted retaining ring 40 may be suitably fabricated of a high strength, high temperature endurance polymeric material such that it can be easily molded. One of such suitable materials may be polyphenylene sulfide or PPS polymer. Any other suitable polymeric material may also be used.

As shown in FIGS. 4A and 4B, the base portion 54 of the trapezoidal shape may be suitably formed between about 5 mm and about 15 mm, while a width of the tip portion 56 of the trapezoidal shape may be between about 1 mm and about 8 mm. A suitable depth of the slot recess may be at least 1 mm, and preferably at least 2 mm. As shown in FIG. 4A, the two sloped sides of the trapezoidal shape may each have an angle between about 40° and about 70° as measured from a tangent line to the outer periphery 52 of the toroidal ring member 44. While the angles of 45° and 60° are shown in FIG. 4A, it should be recognized that any other suitable angles may also be utilized for forming the trapezoidal shape slot recess.

Figure 5:
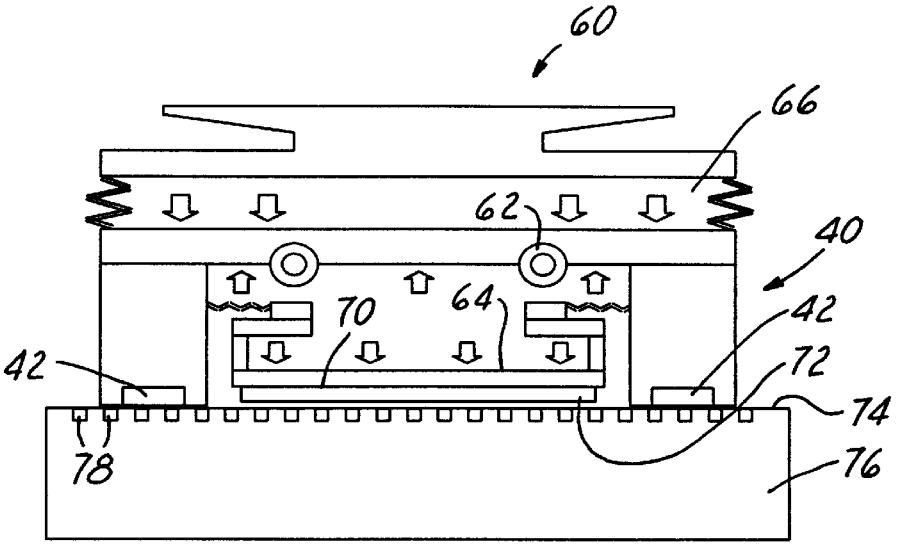
FIG. 5 is a cross-sectional view of the present invention slotted retaining ring positioned on a grooved polishing pad.

A cross-sectional view of the present invention slotted retaining ring 40 installed in a chemical mechanical polishing apparatus 60 is shown in FIG. 5. An innertube 62 and a membrane 64 together with a pressurized chamber 66 are used to press a wafer 70 in a downward direction such that a surface 72 of the wafer 70 to be polished contacts the top surface 74 of the polishing head 76 tightly under a suitable pressure. On the top surface 74 of the polishing pad 76, a multiplicity of grooves 78 are provided to facilitate the distribution of slurry solution (not shown) evenly on the top surface 74. When the present invention slotted retaining ring 40 is utilized which incorporates slot recesses 42, more slurry solution which is carried by the slot recess 42 is pushed into the grooves 78 on the surface 74 of the polishing pad 76. A more uniform distribution and a larger volume of the slurry solution is therefore available for the polishing process which occurs on the wafer surface 72. By utilizing the present invention novel slotted retaining ring 40 it has been found that at least between about 40 and 50% of the slurry solution usage can be saved which contributes to a large processing cost saving. Furthermore, a commonly observed fluctuation between wafer-to-wafer polishing rates is also reduced when the present invention slotted retaining ring is used. It has also be found that the polishing thickness uniformity on the same wafer is also improved.

The present invention novel apparatus of a slotted retaining ring for a CMP polishing head and a method for using the ring have therefore been amply demonstrated in the above descriptions and in the appended drawings of FIGS. 4A, 4B and 5.

While the present invention has been described in an illustrative manner, it should be understood that the terminology used is intended to be in a nature of words of description rather than of limitation.

Furthermore, while the present invention has been described in terms of a preferred embodiment, it is to be appreciated that those skilled in the art will readily apply these teachings to other possible variations of the inventions.

The embodiment of the invention in which an exclusive property or privilege is claimed are defined as follows:

What is claimed is:

1. A slotted retaining ring adapted for holding a chemical mechanical polishing head comprising:

a toroidal ring member having parallelly situated planar top and bottom surfaces, said toroidal ring member further having an inner periphery defined by an inner diameter and an outer periphery defined by an outer diameter, said inner diameter being sufficiently large for holding a polishing head therein, and a plurality of slot recesses in said bottom surface of said toroidal ring, each of said plurality of slot recesses being formed in a tapered shape having a base portion adjacent to said outer periphery and a tip portion of a smaller width than said base portion adjacent to said inner periphery.

2. A slotted retaining ring adapted for holding a chemical mechanical polishing head according to claim 1, wherein said torodial ring member being formed in a concentric ring having parallelly situated planar top and bottom surfaces.

3. A slotted retaining ring adapted for holding a chemical mechanical polishing head according to claim 1, wherein said toroidal ring member having a rectangular cross-section.

4. A slotted retaining ring adapted for holding a chemical mechanical polishing head according to claim 1, wherein said plurality of slot recesses comprises at least four slot recesses.

5. A slotted retaining ring adapted for holding a chemical mechanical polishing head according to claim 1, wherein said plurality of slot recesses comprises at least eight slot recesses.

6. A slotted retaining ring adapted for holding a chemical mechanical polishing head according to claim 1, wherein said tapered shape of said slot recesses is a triangular shape.

7. A slotted retaining ring adapted for holding a chemical mechanical polishing head according to claim 1, wherein said tapered shape of said slot recesses is a trapezoidal shape.

8. A slotted retaining ring adapted for holding a chemical mechanical polishing head according to claim 7, wherein said trapezoidal shape having a tip portion that is spaced apart from said inner periphery of said toroidal ring member.

9. A slotted retaining ring adapted for holding a chemical mechanical polishing head according to claim 7, wherein said two sloped sides of said trapezoidal shape each having an angle between about 40° and about 70° as measured from a tangent line to said outer periphery of said ring member.

10. A slotted retaining ring adapted for holding a chemical mechanical polishing head according to claim 7, wherein a width of a bottom side of said trapezoidal shaped slot recess is between about 5 mm and about 20 mm, and width of a top side of said trapezoidal shaped slot recess is between about 1 mm and about 8 mm.

11. A chemical mechanical polishing head comprising:

a slotted retaining ring constructed by a toroidal ring member having parallelly situated planar top and bottom surfaces, said toroidal ring member further having an inner periphery defined by an inner diameter and an outer periphery defined by an outer diameter, said inner diameter being sufficiently large for holding a polishing head therein, and plurality of slot recesses in said bottom surface of said toroidal ring, each of said plurality of slot recesses being formed in a tapered shape having a base portion adjacent to said outer periphery and a tip portion of a smaller width than said base portion adjacent to said inner periphery, and a membrane assembly adapted for mounting inside said slotted retaining ring and for carrying a wafer having a surface to be polished therein said bottom surface having a plurality of slot recesses of said slotted retaining ring being substantially in the same plane as said surface of the wafer to be polished.

12. A chemical mechanical polishing head according to claim 11, wherein said toroidal ring member having a rectangular cross-section.

13. A chemcial mechancial polishing head according to claim 11, wherein said plurality of slot recesses comprises between about 4 and about 16 slot recesses.

14. A chemcial mechancial polishing head according to claim 11, wherein said tapered shape of said slot recesses is a triangular or a trapezoidal shape.

15. A chemcial mechancial polishing head according to claim 14, wherein said trapezoidal shape having a top portion that is spaced apart from said inner periphery of said toroidal ring member.

16. A method for chemical mechanical polishing a semiconductor wafer by using a polishing head equipped with a slotted retaining ring comprising the steps of:

providing a retaining ring adapted for holding a CMP head including a toroidal ring member having parallelly situated planar top and bottom surfaces, said toroidal ring member further having an inner periphery, forming taper-shaped slot recesses in a triangular or trapezoidal shape on said planar bottom surface with a tip portion spaced-apart from said inner periphery of the retaining ring, mounting a polishing head inside said slotted retaining ring such that a front surface of a wafer mounted in said polishing head to be polished is substantially in the same plane as said bottom surface of said slotted retaining ring, and rotating said slotted retaining ring in a direction such that said base portion adjacent to said outer periphery of said toroidal ring member being advanced toward a slurry solution dispensed on a polishing pad.

17. A method for chemical mechanical polishing a semiconductor wafer by using a polishing head equipped with a slotted retaining ring according to claim 16, wherein said slotted retaining ring being rotated in a circular motion.

18. A method for chemical mechanical polishign a semiconductor wafer by using a polishing head equipped with a slotted retaining ring according to claim 16, wherein said slotted retaining ring being rotated in a clockwise direction such that a flow of slurry solution being fed from said outer periphery to said inner periphery of said slotted retaining ring.

19. A method for chemical mechanical polishign a semiconductor wafer by using a polishing head equipped with a slotted retaining ring according to claim 16 further comprising the step of providing at least 4 slot recesses in said bottom surface of said toroidal ring.

20. A method for chemical mechanical polishign a semiconductor wafer by using a polishing head equipped with a slotted retaining ring according to claim 16 further comprising the step of providing at least 8 slot recesses in said bottom surface of said toroidal ring for feeding a flow of slurry solution from said outer periphery to said inner periphery of said slotted retaining ring.

21. A method for chemical mechanical polishign a semiconductor wafer by using a polishing head equipped with a slotted retaining ring according to claim 16 further comprising the step of chemical mechanical polishing said semiconductor wafer after an oxide deposition step, a tungsten deposition step or a polysilicon deposition step.

* * * * *